US006681666B2

(12) United States Patent
Pfaff, Jr.

(10) Patent No.: US 6,681,666 B2
(45) Date of Patent: Jan. 27, 2004

(54) METHOD AND APPARATUS FOR SCRAP REMOVAL FROM ROTARY DIES

(76) Inventor: Alan R. Pfaff, Jr., 3512 Macnichol Trail, Orchard Lake, MI (US) 48323

( * ) Notice: Subject to any disclaimer, the term of this patent is extended or adjusted under 35 U.S.C. 154(b) by 0 days.

(21) Appl. No.: 10/034,441

(22) Filed: Dec. 27, 2001

(65) Prior Publication Data

US 2003/0089205 A1 May 15, 2003

Related U.S. Application Data

(60) Provisional application No. 60/258,694, filed on Dec. 28, 2000.

(51) Int. Cl.[7] ..... B26D 7/18

(52) U.S. Cl. ..... 83/128; 83/347; 83/348; 83/111; 83/124; 76/107.1

(58) Field of Search ..... 83/23, 343, 663, 83/700, 154, 117, 27, 111, 118, 124, 128, 347, 348

(56) References Cited

U.S. PATENT DOCUMENTS

| | | | | |
|---|---|---|---|---|
| 3,796,851 A | | 3/1974 | Pfaff, Jr. | |
| 4,197,154 A | | 4/1980 | Pfaff, Jr. | |
| 4,223,835 A | * | 9/1980 | Witt et al. | 238/14 |
| 4,561,334 A | * | 12/1985 | Sarka | 83/27 |
| 5,003,854 A | | 4/1991 | Capdebosco | |
| 5,027,509 A | | 7/1991 | Barben et al. | |
| 5,088,367 A | | 2/1992 | Cracchiolo et al. | |
| 5,365,815 A | | 11/1994 | Pfaff, Jr. | |
| 5,379,671 A | | 1/1995 | Kang | |
| 5,417,132 A | | 5/1995 | Cox et al. | |
| 5,575,185 A | * | 11/1996 | Cox et al. | 76/107.1 |
| 5,842,399 A | | 12/1998 | Pfaff, Jr. | |
| 6,085,626 A | | 7/2000 | Pfaff, Jr. | |
| 6,178,852 B1 | | 1/2001 | Pfaff | |
| RE37,366 E | | 9/2001 | Cox et al. | |

* cited by examiner

*Primary Examiner*—Allan N. Shoap
*Assistant Examiner*—Phong Nguyen
(74) *Attorney, Agent, or Firm*—Woodard, Emhardt, Moriarty, McNett & Henry LLP

(57) ABSTRACT

An improved rotary die cutting apparatus and method for removing scrap material from work pieces such as paperboard blanks. One of the dies of a pair of rotary cutting dies is provided with gripper elements that extend over at least a portion of the area of the die corresponding to the areas over which the scrap portions are generated. The gripper elements grip, without piercing completely through, the scrap portions generated by the cutting operation of the dies. A stripping knife extends across the die carrying the scrap portions at a height above the gripper elements that provides clearance between the gripper elements and the stripping knife but contacts the scrap portions retained on the gripper elements.

19 Claims, 6 Drawing Sheets

METHOD AND APPARATUS FOR SCRAP REMOVAL FROM ROTARY DIES

This application claims the benefit of U.S. Provisional Application Serial No. 60/258,694, filed Dec. 28, 2000.

BACKGROUND

The present invention relates generally to the field of rotary die cutting devices which are useful for manufacture of carton blanks and other workpieces from sheets or webs of material, and particularly to rotary die cutting machines used in high speed rotary cutting of a moving sheet or web of paper, paperboard, plastics and composite materials.

As one example, rotary die cutting machines are used for the high speed mass production of paperboard carton blanks that are subsequently folded into the shape of carton or box containers. In rotary die cutting, the cutting operations can occur by either of two methods, the first being referred to in the trade as rotary pressure ("RP") cutting and the second as the "crush cut" method. In the rotary pressure cutting method, the paperboard material from which the carton blanks are generated is advanced at high speed between two rotary die cutting cylinders. The cylinders are provided with cutting elements on them which cooperate to form cutting dies to cut the desired shape of the carton blank as the material advances between the cylinders. The cylinders rotate at the same speed so as to maintain registration of the co-acting cutting surfaces. Each rotation of the cylinders generates a discrete series of one or more cartons depending upon the size of the cartons, diameters of the cylinders, etc. In the crush cut method, one of the cylinders, the cutting cylinder, is provided with knife blades that perform the cutting operation and the other cylinder, known as the anvil cylinder, provides a smooth surface against which the knife blades operate.

In both the above described processes there is necessarily generated a certain amount of scrap material. This material needs to be separated from the carton blanks and removed from the dies as each revolution of the cylinders generates a new series of carton blanks. There are various ways in which the scrap removal process is conventionally performed. In one method, the scrap material is initially retained on one of the die cylinders by stripping pins that hold the scrap pieces onto that cylinder as the carton blanks are advanced away. Thereafter, the scrap pieces are removed from the die cylinder by a stripping comb. Alternatively, scrap removal is accomplished separately from the cutting operation. In this method, the carton blank and scrap pieces are retained as contiguous pieces by leaving uncut during the cutting operation. The attached pieces are then carried to a stripping station. At the stripping station, the scrap material is removed from the carton blank by piercing the scrap portions with stripping pins carried on a rotating cylinder. As in the previous method, the scrap pieces are retained on the pins by the rotating cylinder until they are stripped off the pins by a stripping comb. A yet further alternative system employs a stripping station which removes the scrap pieces by rotatably registering male elements to "punch" the scrap from the moving web of pre-cut products.

All of the above described methods of scrap removal are expensive operations that add significantly to the cost of rotary die cutting and require time and labor intensive adjustments to optimize their operation in a coordinated fashion with the die cutting operation. For example, the location and number of stripping pins varies for each die and their installation can involve a certain amount of trial and error. Further, each of the stripping pins must be individually mounted to the die. For this purpose, each stripping pin is typically provided with a screw threaded base which mounts within complementary threaded mounting holes tapped into the portions of the die where the scrap material is generated. In addition, for each stripping pin a corresponding registration hole must be drilled or otherwise formed in the opposing die. These holes must be precisely located to register with the stripping pins, and so the need for these holes also increases the cost of the dies. A further disadvantage arises due to the size of the stripping pins. Occasionally, the scrap pieces are very small and it is difficult due to the minimum practical size of the pins and mounting holes to locate them where they are needed. Since the pin locations vary for each die, the stripping combs must also be custom-built for each die, it being necessary for the pins to pass between the teeth of the comb as the scrap material is being stripped from the die.

SUMMARY OF THE INVENTION

An improved rotary die cutting apparatus and method for removing scrap material from work pieces such as paperboard blanks. One of the dies of a pair of rotary cutting dies is provided with gripper elements that extend over at least a portion of the area of the die corresponding to the areas over which the scrap portions are generated. The gripper elements grip, without piercing completely through, the scrap portions generated by the cutting operation of the dies. A stripping knife extends across the die carrying the scrap portions at a height above the gripper elements that provides clearance between the gripper elements and the stripping knife but contacts the scrap portions retained on the gripper elements. The stripping knife dispenses with the need for multiple custom built stripping combs corresponding to each set of dies. The gripping elements dispense with the need for individually mounted stripping pins and corresponding registering holes. In one preferred aspect of the invention, the gripper elements are formed integrally with the rotary cutting die by employing conventionally known masking and etching techniques. The invention can be employed with rotary cutting dies employing either rotary pressure cutting or crush cut methods of operation.

DESCRIPTION OF THE PREFERRED EMBODIMENTS

Figure 1:
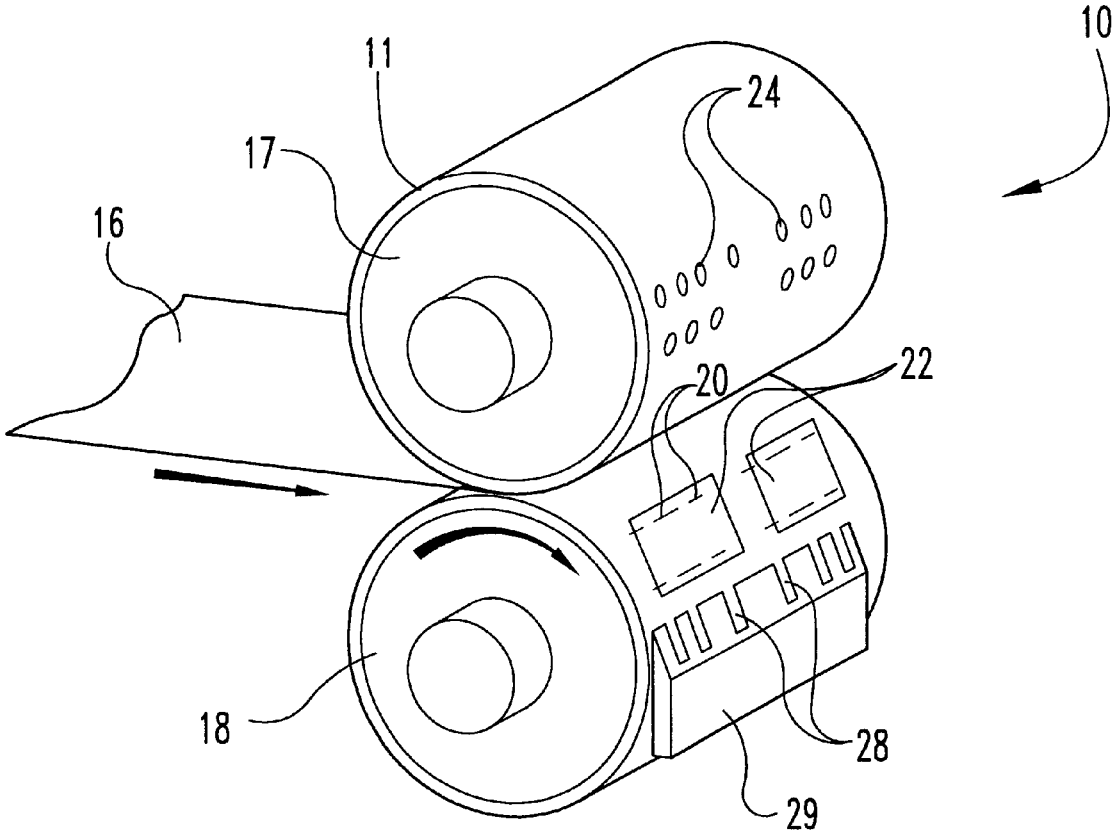
Fig. 1 (Prior Art)
FIG. 1 schematically illustrates a typical example of a prior art rotary pressure type die cutting apparatus provided with conventional stripping pins and a stripping comb for scrap removal. For purposes of clarity, the cutting elements on the upper and lower dies are not shown.
Figure 2:
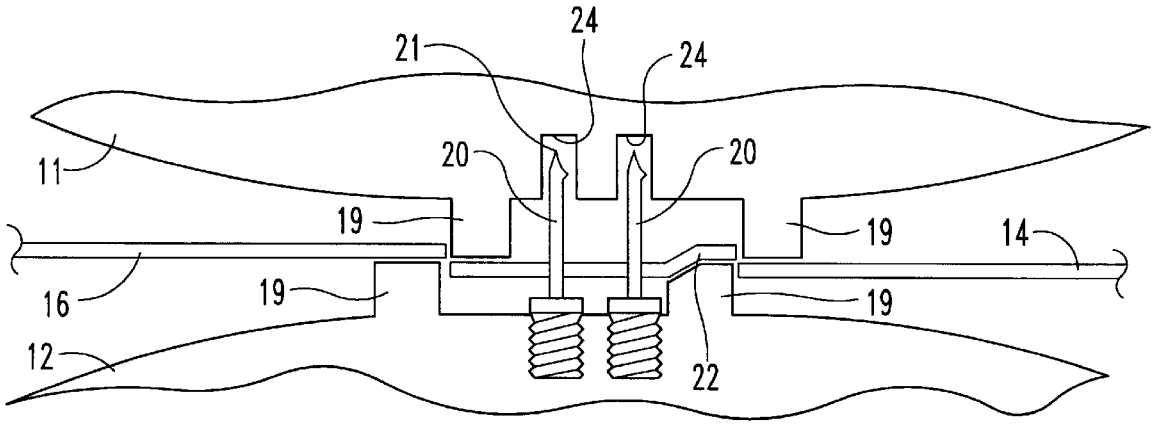
Fig. 2 (Prior Art)
FIG. 2 is a fragmentary section view of the rotary die cutting system of FIG. 1, but further showing the cutting elements on the upper and lower dies.
Figure 3:
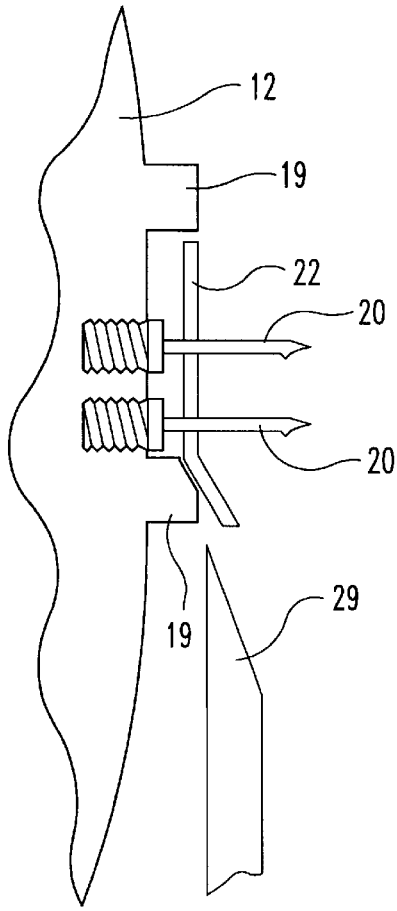
Fig. 3 (Prior Art)
FIG. 3 is a fragmentary section view showing the lower die cutting cylinder rotated clockwise 90 degrees from the position shown in FIG. 2, at the position where the scrap removal step is performed.

Referring now to the drawings in detail, and particularly FIGS. 1–3, there is shown a conventional rotary die cutting apparatus of a rotary pressure cutting type well known in the prior art generally designated at 10. The apparatus comprises a pair of upper and lower rotary dies 11 and 12, respectively, for cutting blanks 14 from a web 16 of sheet material passing between the dies. The upper and lower dies 11 and 12 are removably mounted to carrier cylinders, 17 and 18, respectively. The blanks 14 are generated by cutting the moving web 16 between co-acting edges of cutting elements 19 located on the upper and lower dies as the cylinders 17 and 18 are rotated in synchronicity in opposite directions of rotation by a suitable drive mechanism (not shown). Stripping pins 20 are mounted to the lower die 12 in those areas where scrap portions 22 are generated by the cutting process. Typically, the upper die 11 is provided with clearance holes 24 that register with each of the pins 20 as the pins reach the cutting position of the dies.

Figure 4:
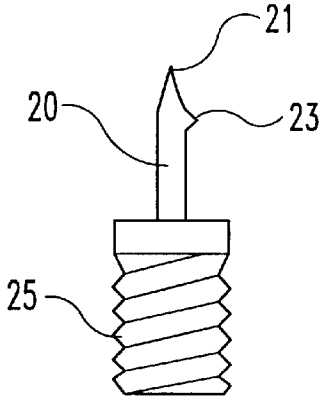
Fig. 4 (Prior Art)
FIGS. 4 and 5 are side elevation and top views, respectively, of a prior art stripping pin of conventional design.
Figure 5:
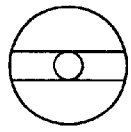
Fig. 5 (Prior Art)

Referring now to FIGS. 4 and 5, the stripping pins 20 typically are provided with a relatively sharp tip 21 adapted to pierce through the workpiece material, such as paperboard or plastic, and thereby retain the scrap portions as the blank portions advance through the space between the dies. In addition, the pins 20 may include a barb or undercut, such as at 23, to facilitate retention of the scrap portions thereon. A male threaded portion 25 allows the stripping pins to be screw mounted to the die inside tapped mounting holes.

Referring again to FIG. 2, it can be seen that the tips of the stripping pins 20 extend above the top surfaces of the cutting elements 19. As the lower cylinder continues to rotate in a clockwise direction 90 degrees to the position shown in FIG. 3, scrap portions 22 retained on the lower die by stripping pins 20 will come into contact with teeth 28 of stripping comb 29. The pins 20 do not come into contact with the stripping comb because they pass through the spaces between the teeth 28.

There are several disadvantages associated with the use of the stripping pins 20. One is that the pins 20 are relatively expensive to install as they require individually tapped holes whose location varies with each different die. Then too, because the locations of the pins changes with each die, the teeth pattern of the stripping comb must be customized to correspond to the pin locations for each corresponding die. A further problem is occasioned by the size of the pins themselves. Practically speaking, the minimum diameter of the tapped holes is approximately ⅛–3/16 inch and this can in some circumstances place undesirable limitations on the pin locations and/or the number of pins that can be installed within a given space.

Referring now to FIGS. 6–9, a preferred embodiment of the rotary die cutting apparatus of the present invention is generally designated at 40. For ease of understanding, identical reference numerals will be used to describe elements identical or similar to those described in the previously described embodiment. The apparatus 40 comprises a pair of upper and lower rotary dies 41and 42, removably mounted to carrier cylinders 17 and 18, respectively. Although the dies and carrier cylinders are shown as separate elements, it should be understood that dies 41 and 42 can alternatively be integrally formed with their respective carrier cylinders. Co-acting cutting elements 19 are provided on the upper and lower dies for cutting blanks 14 from a web 16 of sheet material passing between the dies. As in the previous embodiment, the blanks 14 and scrap portions 22 are generated by cutting the moving web 16 between co-acting edges of cutting elements 19 as the dies are rotated on cylinders 17 and 18 in synchronicity in opposite directions of rotation. The lower die 42 is constructed similar to lower die 12 of the previous embodiment except that instead of employing stripping pins 20, die 42 is provided with gripping elements 52 that serve to grip, without piercing substantially through, the scrap portions 22. The gripping elements 52 are preferably formed integrally with the lower die 12 employing any of several conventional metal removal techniques such as electrical discharge machining, photo-etching, or chemical etching techniques known in the art.

Figure 7A:
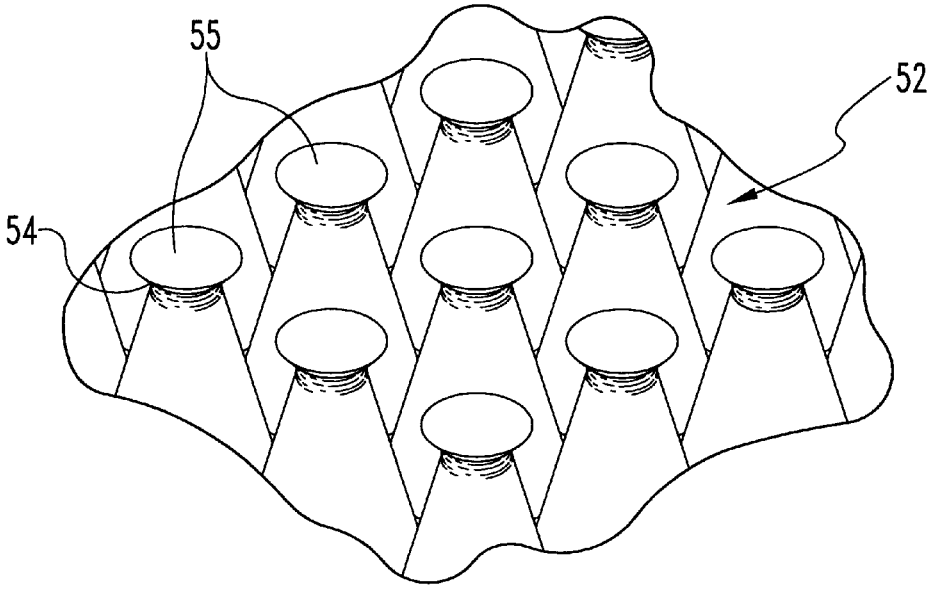
FIG. 7*a* is a fragmentary perspective view showing the gripping elements greatly enlarged relative to FIG. 6 so that details of their shape may be seen.
Figure 7B:
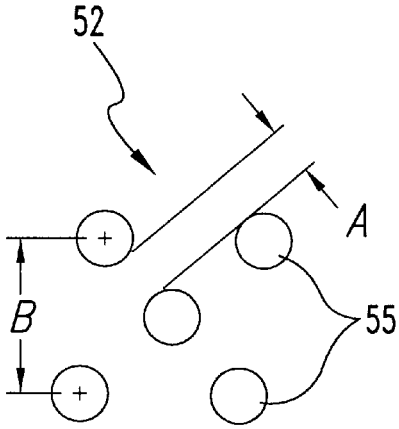
FIG. 7*b* is a top plan view diagrammatically showing details of the spacing of the gripping elements.
Figure 7C:
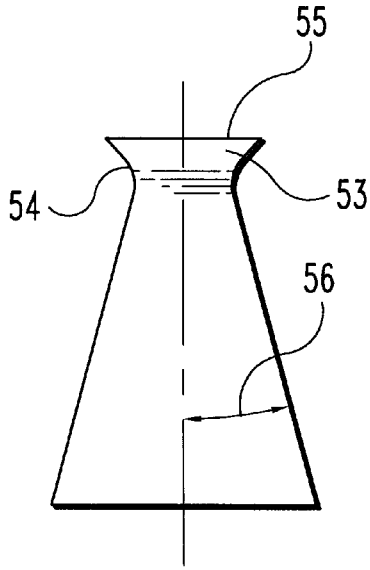
FIG. 7*c* is an elevation view of a gripping element.
Figure 8:
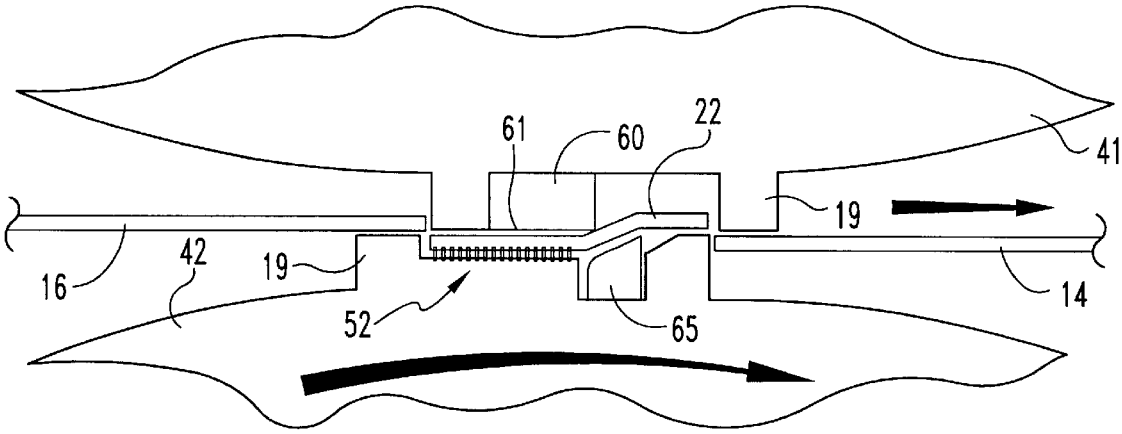
FIG. 8 is a fragmentary section view of the rotary die cutting apparatus of FIG. 6.

FIG. 7*a–c* show details of the gripping elements 52 greatly enlarged to reveal their shape and spacing. As seen in FIG. 7*a*, each of the gripping elements 52 have the general shape of truncated cones except that the upper portion is modified to incorporate an undercut 54 or reverse taper which gives it a sort of mushroom shaped appearance. The purpose of the undercut 54 is to provide for increased gripping force. The size of the gripping elements 52 may vary with the thickness and type of sheet material 16 being used to generate the blanks 14. Generally, it is anticipated that the top diameter of the gripping elements 52 will be sized in a range of 0.0001" to about 0.030" and the overall height will range from about 0.001" to about 0.030". As an example, for a paperboard material having a thickness of about 0.010 inches gripping elements 52 may have a height of about 0.015 inches, a top diameter of about 0.003 inches and a taper 56 (which may be straight or curved) in a range between 0 to 15 degrees.

FIG. 7*b* shows only the top surfaces 55 of the gripping elements so that details of their arrangement and spacing is made apparent. As seen in FIG. 7*b*, the gripping elements 52 are patterned in rows similar to the pattern of teeth in a conventional file tool. The pattern can for example be isosceles triangles, equilateral triangles, or right triangles. In order to maximize the number of gripping elements 52 within a given area and thereby increase the gripping force, the spacing between them can be reduced, or alternatively may be increased if less gripping force is required. A range of spacing densities of gripping elements have been successfully tested varying from 25 to 400 gripping elements per square inch of surface area. For example, in one desired arrangement where the gripping elements having a height of 0.015 inches are patterned in isosceles triangles, the diameter of the top surfaces is 0.003 inches, the spacing "A" is 0.032 inches and the spacing "B" is 0.029 inches. Further, it should be appreciated that for any given thickness of the sheet material, it is contemplated that the gripping elements 52 will be sized so that they cannot pierce completely through the scrap portions 22 of sheet material 16. Preferably also, the top surface 55 of the gripping elements should not extend above the cutting elements 19 on lower die for reasons which will be explained later herein.

Referring again to FIG. 6, upper die 41 has a construction similar to die 11 of the previous embodiment, except that in addition to the cutting elements 19 there is also provided one or more support pads 60 in the areas of the die where scrap portions 22 are generated by the cutting operation. The support pads 60 may be integrally formed with the upper die 41, or alternatively may be separately formed from the die 41 and mounted thereto by bolts or other suitable fastening means. The purpose of the support pads 60 is to provide a surface against which the scrap portions 22 may bear and thereby be forced into engagement with the gripping elements 52. It is to be appreciated that the distance between the bearing surfaces 61 of support pads 60 and the top surfaces 55 of the gripping elements 52 determines the distance to which the gripping elements 52 pierce into the scrap portions 22.

Figure 6:
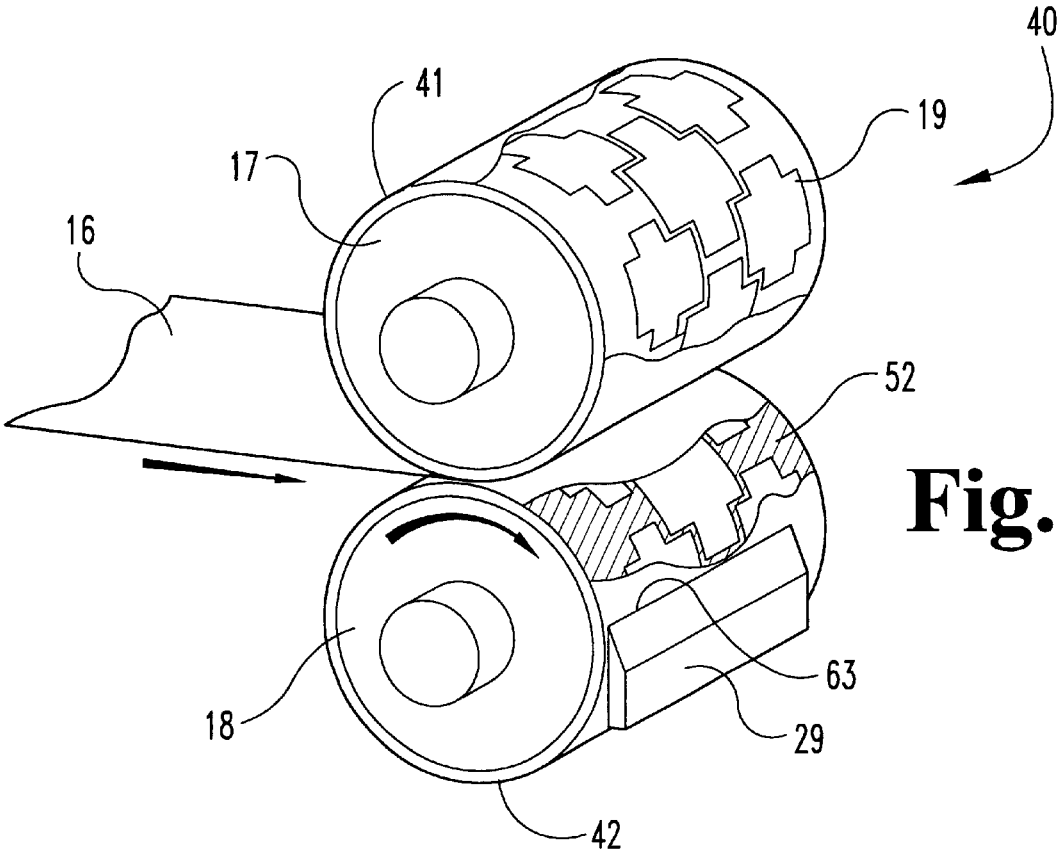
FIG. 6 illustrates a preferred embodiment of the rotary die cutting apparatus of the present invention with a web of paperboard material moving there through as the cutting step is performed.
Figure 9:
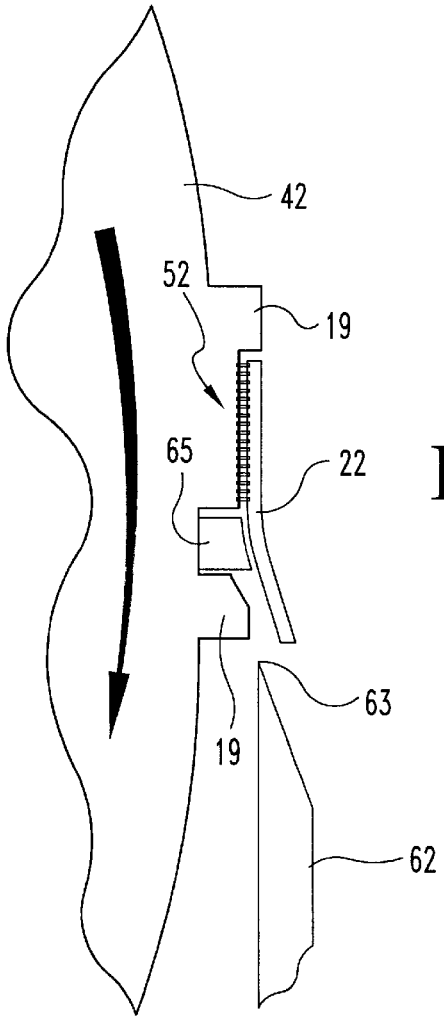
FIG. 9 is a fragmentary section view showing the lower die cutting cylinder rotated clockwise 90 degrees from the position shown in FIG. 8, at the position where the scrap removal step is performed.

As seen in FIGS. 6 and 9, rotary die cutting apparatus 40 is also provided with a stripping knife 62 which takes the place of stripping comb 19 in the prior art embodiment. Blade edge 63 of knife 62 extends along the full length of the lower rotary die 42 at a height sufficiently above the cutting elements 19 to allow clearance as the cutting elements rotate past edge 63. The position of the scrap portions 22 as seen in FIG. 9 are rotated 90 degrees clockwise from their position shown in FIG. 8. At this position, the leading edge of the scrap portions will contact the blade edge 63 of knife 62 and will be stripped from the gripping elements 52. Ejection material 65 mounted on lower rotary die 42 urges the leading edges of the scrap portions 22 to extend outwardly from die 42 a sufficient distance to ensure that scrap portions 22 will make contact with and be removed by the stripping knife 62. Ejection material 65 is preferably formed of a suitable elastomeric material.

While in the foregoing there has been disclosed the preferred forms of the rotary die cutting apparatus of the present invention, it should be appreciated that departures therefrom may be made which incorporate the essential features of the invention as may be set forth in the claims. For example, the gripping elements could be provided with sharp, rounded or barbed tips and still perform their gripping function without piercing completely through the scrap portions. So long as the gripping elements do not extend through the scrap portions, there is no potential for interference with the stripping knife during the scrap removal step.

Figure 10:
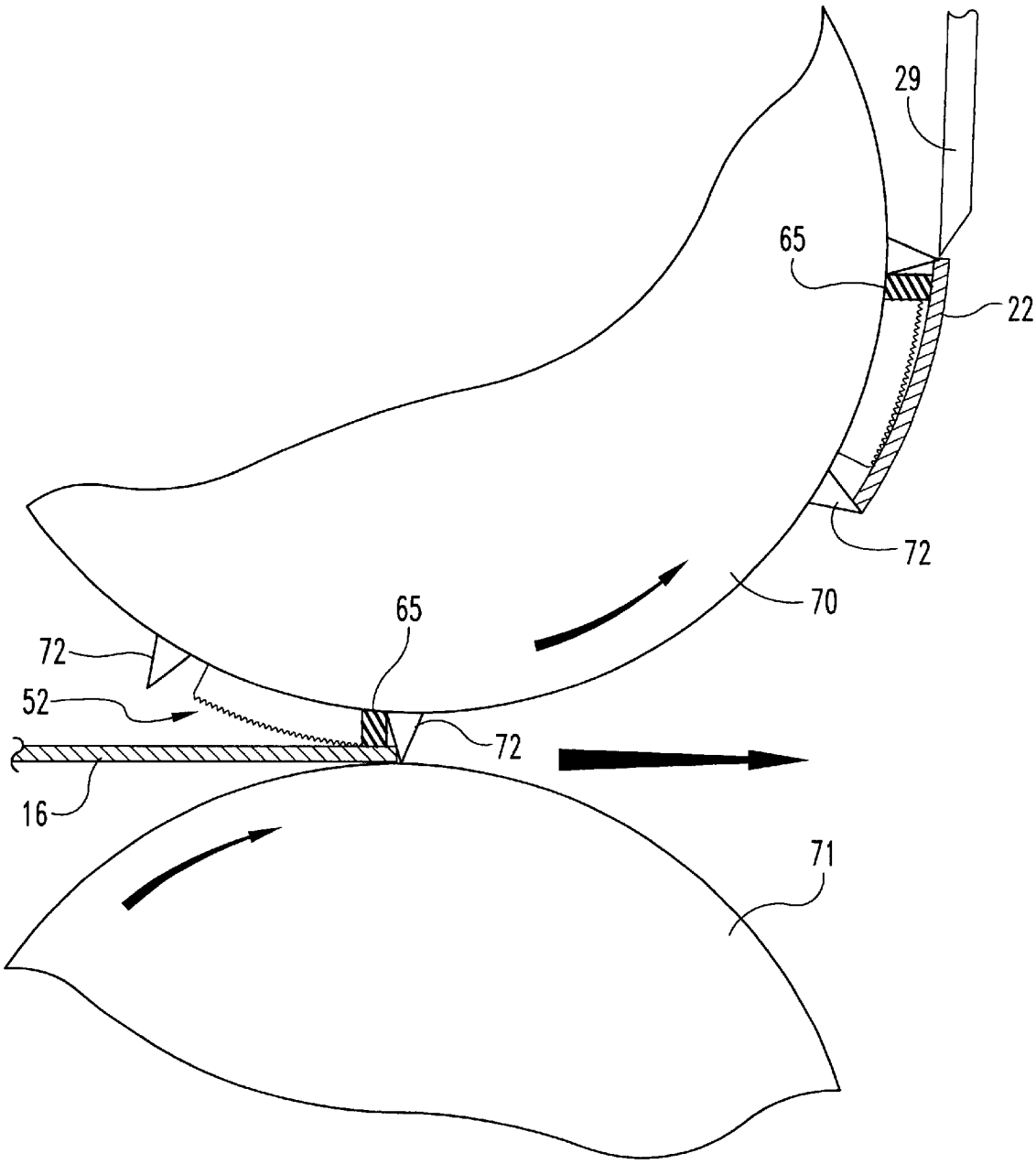
FIG. 10 is a schematic view of an alternative embodiment of the present invention in a "crush cut" type rotary die apparatus.

Further, while the invention is described in connection with a rotary pressure cutting method where there are cutting elements on both the upper and lower dies, the invention is also useful with "crush cut" methods which employ cutting elements on only one of the dies (e.g., the "carrier" die) and co-act against an anvil cylinder. In such an application, such as is depicted in FIG. 10, the gripping elements 52 are formed on the carrier cylinder 70 that also carries the cutting elements 72. An advantage to this arrangement is that the anvil cylinder 71 does not need to be the same diameter as the carrier cylinder 70. This is because the anvil cylinder no longer needs to be provided with registering holes to receive stripping pins that must align precisely with the pins on each revolution of the dies. Accordingly, one universal size anvil cylinder can be used with various sized carrier cylinders, and the anvil cylinder does not need to be changed when a different die is employed. Preferably, the anvil cylinder can be sized so that its diameter is larger than the diameter of the carrier cylinders so as to increase the wear life of the anvil cylinder as much as possible.

What is claimed is:

1. An improved rotary die cutting apparatus for cutting a moving web of material into blanks, said apparatus comprising:

a pair of carrier cylinders;

upper and lower rotary dies removably mounted to said carrier cylinders, at least one of said rotary dies having cutting elements thereon adapted to generate blanks and scrap portions from the moving web of material;

gripping elements extending from at least one of said rotary dies, said gripping elements registering with said scrap portions as said rotary dies rotate, said gripping elements sized and positioned so as not to pierce completely through said scrap portions, said gripping elements having the shape of truncated cones having an undercut upper portion; and a stripping knife having a blade edge for contacting the leading edges of said scrap portions as said scrap portions are stripped away from said gripping elements.

2. The apparatus of claim 1 wherein said upper and lower rotary dies have co-acting cutting elements thereon.

3. The apparatus of claim 1 wherein said gripping elements have a top surface that does not extend above said cutting elements.

4. The apparatus of claim 1 wherein one of said rotary dies is provided with support pads in the areas of said die where said scrap portions are generated by the cutting action of said rotary dies.

5. The apparatus of claim 1 and further comprising ejection material mounted on one of said rotary dies adjacent said gripping elements.

6. The apparatus of claim 1 wherein said gripping elements are integrally formed with one of said rotary dies.

7. The apparatus of claim 1 wherein said gripping elements are arranged in a closely spaced grid like pattern of isosceles triangles.

8. The apparatus of claim 7 wherein said gripping elements are approximately equally spaced apart.

9. The apparatus of claim 1 wherein for a web material having a thickness of about 0.010 inches said gripping elements have a height of about 0.015 inches.

10. The apparatus of claim 7 wherein said gripping elements are closely spaced together within a range of from about 25 to about 400 gripping elements per square inch.

11. An improved rotary die cutting apparatus for cutting a moving web of material into blanks, said apparatus comprising:

upper and lower rotary dies, at least one of said rotary dies having cutting elements thereon adapted to generate blanks and scrap portions from the moving web of material;

gripping elements extending from at least one of said rotary dies, said gripping elements registering with said scrap portions as said rotary dies rotate, said gripping elements sized and positioned so as not to pierce completely through said scrap portions, said gripping elements arranged in a closely spaced pattern in a range of about 25 to about 400 gripping elements per square inch; and a stripping knife having a blade edge for contacting the leading edges of said scrap portions as said scrap portions are stripped away from said gripping elements.

12. The apparatus of claim 11 wherein one of said rotary dies forms an anvil cylinder.

13. The apparatus of claim 11 and further comprising a tool carrying cylinder and wherein at least one of said rotary dies is removably mounted to said tool carrying cylinder.

14. The apparatus of claim 13 and further comprising a pair of tool carrying cylinders, and wherein said upper and lower dies are removably mounted to said pair of tool carrying cylinders.

15. The apparatus of claim 11 wherein said gripping elements have a top surface that does not extend above said cutting elements.

16. The apparatus of claim 15 wherein one of said rotary dies is provided with support pads in the areas of said die where said scrap portions are generated by the cutting action of said rotary dies.

17. The apparatus of claim 16 and further comprising ejection material mounted on one of said rotary dies adjacent said gripping elements.

18. The apparatus of claim 17 wherein said gripping elements are integrally formed with one of said rotary dies.

19. A method for removing scrap pieces from blanks cut from a moving web of material in a rotary die cutting operation, comprising the steps of:

advancing the web of material between upper and lower rotary dies having cutting elements on at least one of said rotary dies;

forming blanks and scrap pieces from said web material by cutting the web material with said cutting elements;

gripping said scrap pieces onto gripping elements positioned on one of said rotary dies; and stripping said scrap pieces from said gripping elements with a stripping knife.

* * * * *